US006978891B2

(12) United States Patent
Rutledge

(10) Patent No.: US 6,978,891 B2
(45) Date of Patent: Dec. 27, 2005

(54) DIAGNOSTIC SPECIMEN TRANSPORT PACKAGING AND METHODS OF USE

(75) Inventor: Arthur Rutledge, St. Albert (CA)

(73) Assignee: Saf-T-Pak, Inc., Edmonton (CA)

( * ) Notice: Subject to any disclaimer, the term of this patent is extended or adjusted under 35 U.S.C. 154(b) by 52 days.

(21) Appl. No.: 10/367,272

(22) Filed: Feb. 14, 2003

(65) Prior Publication Data

US 2004/0159568 A1 Aug. 19, 2004

(51) Int. Cl.[7] ..... B65D 69/00; F25D 3/08
(52) U.S. Cl. ..... 206/438; 62/457.2; 422/61
(58) Field of Search ..... 206/438, 210, 206/204; 62/457.1, 457.2, 457.9; 422/61, 422/102; 435/307.1

(56) References Cited

U.S. PATENT DOCUMENTS

| | | | | |
|---|---|---|---|---|
| 2,215,989 A | | 9/1940 | Wolf | |
| 3,507,444 A | | 4/1970 | Werby | |
| 3,625,351 A | | 12/1971 | Eisenberg | |
| 3,675,844 A | | 7/1972 | Sorrell | |
| 3,819,106 A | | 6/1974 | Schuster | |
| 4,276,982 A | | 7/1981 | Sibrava et al. | |
| 4,510,621 A | | 4/1985 | Sak et al. | |
| 4,740,090 A | * | 4/1988 | McNamee | 383/5 |
| 4,927,010 A | * | 5/1990 | Kannankeril | 206/204 |
| 5,199,795 A | | 4/1993 | Russo et al. | |
| 5,236,088 A | * | 8/1993 | Dhority et al. | 206/438 |
| 5,450,948 A | * | 9/1995 | Beausoleil et al. | 206/204 |
| 5,509,255 A | | 4/1996 | Rutledge | |
| 5,569,230 A | * | 10/1996 | Fisher et al. | 604/385.06 |
| 5,833,057 A | * | 11/1998 | Char et al. | 206/204 |
| RE36,071 E | * | 2/1999 | Heacox | 206/210 |
| RE36,132 E | * | 3/1999 | Heacox | 206/210 |
| 5,996,799 A | | 12/1999 | Garreth et al. | |
| 6,769,544 B2 | * | 8/2004 | Rutledge | 206/522 |
| 2002/0144926 A1 | * | 10/2002 | Rutledge | 206/583 |
| 2003/0012701 A1 | * | 1/2003 | Sangha et al. | 422/102 |

FOREIGN PATENT DOCUMENTS

| | | | | |
|---|---|---|---|---|
| GB | 2069456 | * | 8/1981 | 383/16 |

* cited by examiner

*Primary Examiner*—Bryon P. Gehman
(74) *Attorney, Agent, or Firm*—Kilpatrick Stockton LLP

(57) ABSTRACT

A packaging and method for transport of diagnostic specimens meeting regulatory conditions. The packaging comprises a diagnostic specimen, a cryovial, a specimen carrier, an inner bladder, a containment jacket and a shipping container. The containment jacket comprises a transport bag and a cover. The transport bag has an interior cavity capable of receiving specimen carriers and the cover can be secured over the transport bag. The containment jacket is preferably capable of withstanding the maximum intended pressure differential by the industry. The method of transport comprises placing a specimen in a cryovial. The cryovial is placed within a specimen carrier which is in turn placed in an inner bladder. The inner bladder is sealed and placed within a containment jacket. The containment jacket is placed in shipping container and optionally packed with a packing material. The shipping container is preferably capable of withstanding and maintaining temperatures below −200° C.

19 Claims, 2 Drawing Sheets

DIAGNOSTIC SPECIMEN TRANSPORT PACKAGING AND METHODS OF USE

BACKGROUND

Transportation of diagnostic specimens is a major concern for regulators. Diagnostic specimens are typically collected from a patient at a clinical site. However, due to economies of scale and other factors it is often not feasible to conduct the desired tests on the diagnostic specimen at the clinical site. Therefore, it may be necessary to transport the diagnostic specimen from the clinical site to a laboratory to conduct the required testing on the specimen.

Centralized laboratory testing facilities offer economies of scale. Laboratory testing equipment may be very expensive. Due to this significant expense, it may not be cost effective for each clinical site to have such equipment on location in order to analyze the limited number of diagnostic samples collected at that clinic. Centralized laboratory testing facilities, however, provide the ability to make a single investment in laboratory testing equipment with the ability to test samples from numerous clinics. The centralized laboratory facility may perform tests on samples collected at dozens or even more clinical sites.

In order to take advantage of centralized laboratory facilities and the corresponding economies of scale, diagnostic specimens must be transported from the clinical site to the centralized facility. The distance between the clinical site and centralized laboratory facility may be significant, requiring transport through local mail service or private courier service. In order to maintain the diagnostic specimen during transportation, the specimen must preferably be kept in an environment below −20° C. This is done by packaging the specimen in a transport case with dry ice or liquid nitrogen to maintain the proper temperature. Even after the diagnostic specimen reaches the centralized laboratory facility it may need to be preserved for a prolonged period of time. Such preservation is accomplished by placing the specimen in a freezer requiring handling of the specimen packaging.

Problems arise with prior art methods of transporting diagnostic specimens. For example, the pressure vessel described in U.S. Pat. No. 5,509,255 requires a user to place the specimen into an inner specimen bag. The specimen bag is sealed by peeling off the tape, exposing an adhesive. Once the specimen bag is sealed, it is placed in a containment envelope. The containment envelope is sealed by removing the tape and exposing a pressure sensitive adhesive on a flap. The flap is folded towards the body of the containment envelope and sealed. However, pressure sensitive adhesives have been known to fail in temperatures below −20° C. Such a failure of the pressure sensitive adhesive used to seal the containment envelope may expose those handling the bag during transport and storage to the specimen. It is possible that the diagnostic specimen contains an infectious substance, such as the HIV virus. Such exposure to diagnostic specimens during transport is both undesirable and unacceptable to regulators.

Other methods of transportation involve placing the diagnostic specimens in rigid containers. Rigid containers can be problematic for several reasons. For example, when the specimens are packaged with dry ice or liquid nitrogen, under the extreme cold produced by these methods, rigid containers have been known to collapse. Additionally, when the rigid container is removed from the packing conditions and begins to return to room temperature, the container can rupture or explode due to pressure increases from within. A breach in the container could lead to damage to the specimen or to potentially harmful exposure to infectious specimens for individuals.

Central repositories of biological and infectious substances have been a major growth industry recently. Tens of millions of specimens are on deposit with private and government agencies such as the Center for Disease Control, USAMRID and others. These specimens represent a highly valuable resource for researches, public health officials and scientists. Specimens need to be transported to, stored and dispensed from these cites. Typically these specimens are also refrigerated by dry ice or liquid nitrogen at temperatures at least below −20° C. Certain embodiments of the present invention permit the transport of large quantities of specimens in a convenient fashion. Package design is much easier due to the size and flexibility of the containment jacket and inner bladder.

SUMMARY

Certain embodiments of the present invention provide a cost effective and secure way to transport diagnostic specimens meeting all regulatory concerns. Diagnostic specimens may be placed in specimen carriers which are in turn placed in a flexible, air tight, liquid impervious inner bladder. The specimen carriers may contain compartments, with each specimen carrier capable of storing up to one hundred diagnostic specimens per carrier. Each specimen may be individually labeled and recorded by compartment number within a carrier thus allowing for easy reference and organization of the specimens. After the inner bladder is sealed, it may be placed inside a containment jacket for transportation. It should be understood that a plurality of specimen carriers may be placed in the inner bladder.

The containment jacket is preferably made of durable fabric which is permeable to air and liquid. The containment jacket is preferably compatible with dry ice and liquid nitrogen and able to withstand temperatures at least below −20° C. and more preferably below −200° C. The containment jacket is stable at the maximum pressures required by industry regulations for transportation of diagnostic specimens. The interior cavity of the containment jacket is such that multiple specimen carriers can be stacked inside and transported. In certain embodiments, the containment jacket is made of two separate components. The first component is preferably a transport bag comprising a closed, an open end, and an interior cavity. The second component is preferably a cover having a closed end, an open end, and an interior cavity. The cover is preferably slightly larger than the bag allowing the cover to fit over the bag when in use.

The specimen carriers, which are sealed inside the inner bladder, are preferably placed in the cavity of the transport bag which is placed inside the cover so that the closed ends of the components are at opposite ends of the containment jacket. This forms a "closed" containment jacket for transport. The transport bag may be secured in position with the cover by fastener means. In certain embodiments, the transport bag comprises fastening members on the outer surface and the cover comprises hook and loop fastening members on the outer surface. Preferably, the hook and loop fastening members comprise an elongated strap attached to the cover. The loop material portion of the fastener may extend past the open end of the cover while the hook material portion may be attached to the outer surface of the cover. When the cover is placed over the transport bag, the loop material portion of the hook fastener is placed through the transport bag fastening member and folded back upon the hook material portion attached to the outside surface of the cover. Once the hook and loop materials are folded back on one another, they engage one another to secure the transport bag in position within the cover, sealing the containment jacket.

A handle may be attached to the closed ends of each unit for convenience in carrying the containment jacket and for opening the jacket. The handles may be made of a durable flexible fabric with similar properties to the containment jacket material. The containment jacket can be placed in a shipping container either by itself or with other containment jackets. The shipping containers can then be optionally filled with a packing material before transport. The packing material may include, but is not limited to, synthetic shock adsorbing material, dry ice, or liquid nitrogen. The shipping container preferably is capable of maintaining internal temperatures at least below −20° C., and more preferably below −200° C., for an extended period of time.

DETAILED DESCRIPTION

Certain embodiments of the present invention comprise an apparatus and method for transporting diagnostic and other specimens in a manner that meets all applicable industry regulations. As used herein the terms "diagnostic specimen" and "specimen" are interchangeable and include, but are not limited to, proteins, enzymes, antibodies, viruses, ribosomes, DNA, RNA, bacteria, cancer, tissue, protein, etc.

Figure 1:
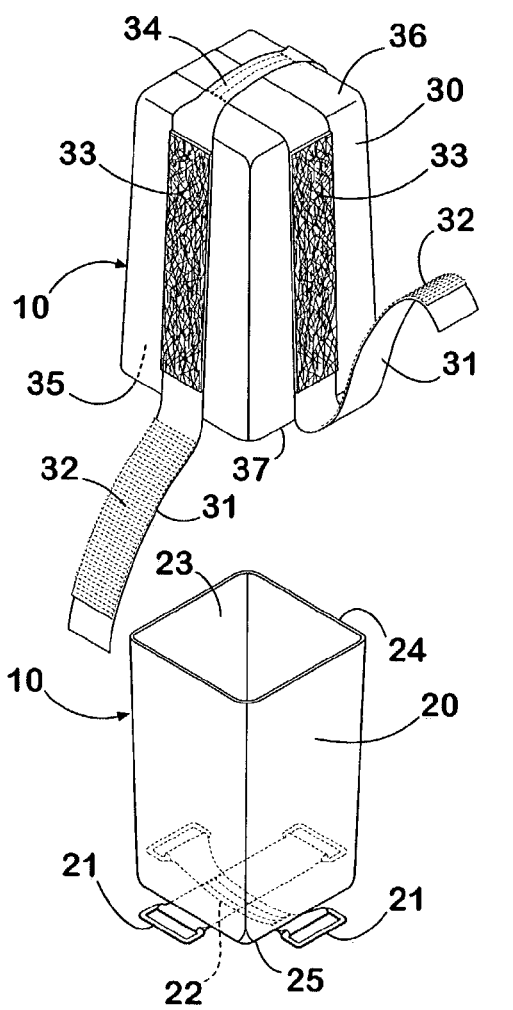
FIG. 1 is a perspective view of a containment jacket.
Figure 2:
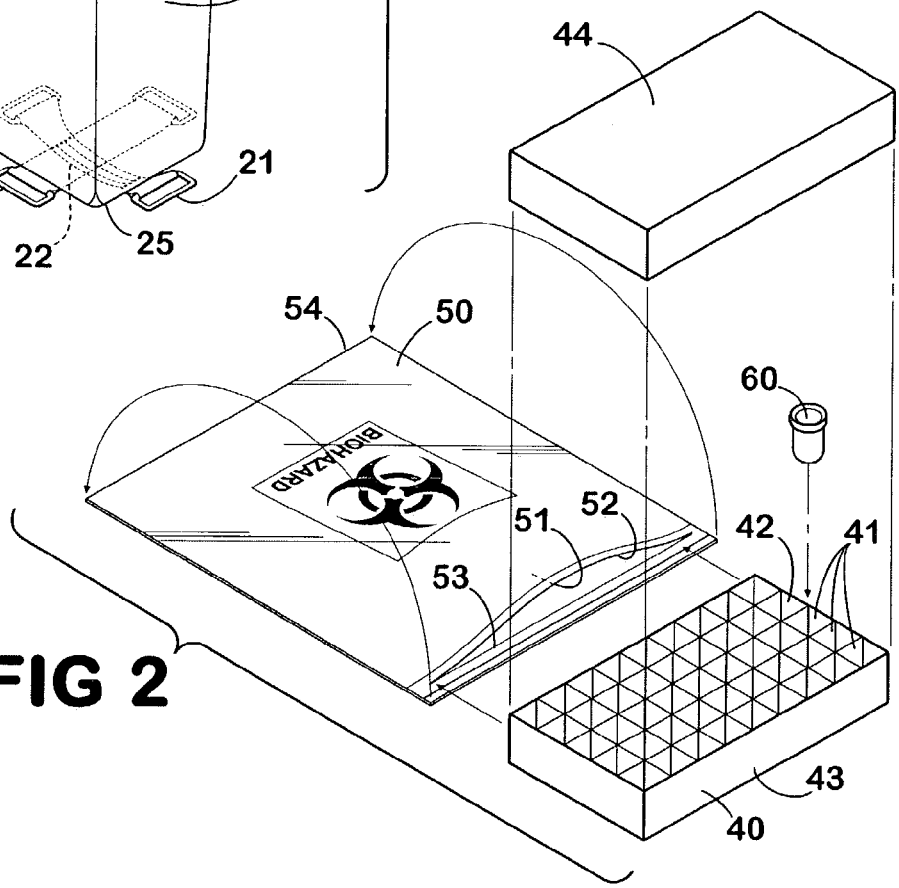
FIG. 2 is a perspective view of a specimen carrier and an inner bladder.
Figure 3:
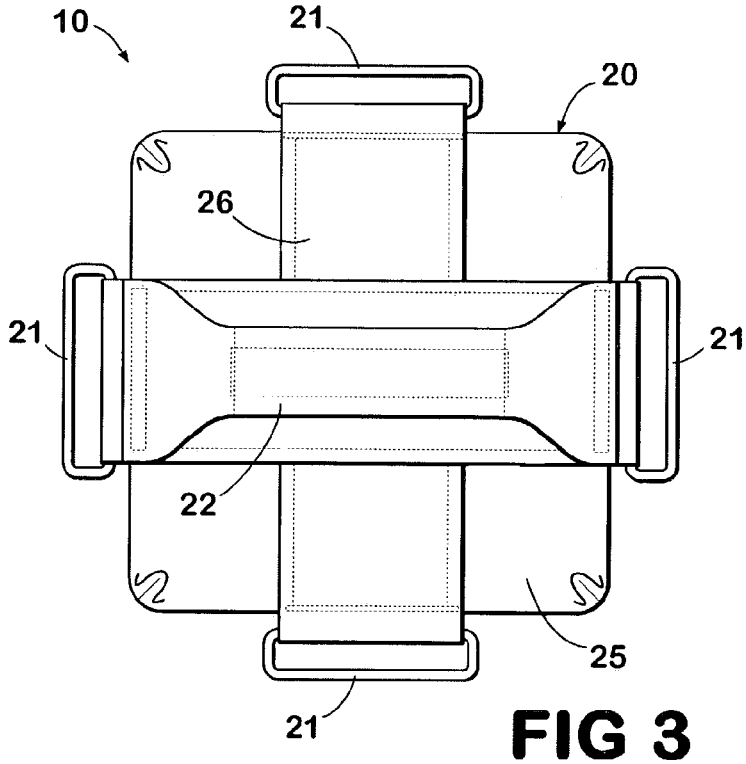
FIG. 3 is a bottom view of the containment jacket.

FIGS. 1 and 2 show a containment jacket 10, an inner bladder 50, a specimen carrier 40 and a cryovial 60. The specimen carrier 40 of the present invention, is capable of receiving up to one hundred diagnostic specimens. In one embodiment of the invention, the diagnostic specimen is placed in a cryovial 60. Preferably, the specimen carrier 40 is capable of receiving between from about eighty and about one hundred diagnostic specimens. In one embodiment, the specimen carrier 40 is divided into individual compartments 41. Each individual compartment 41 is capable of receiving one diagnostic specimen. In a preferred embodiment, each individual compartment 41 may be labeled so that each diagnostic specimen can be identified and organized. The ability to identify and organize the specimens creates an ease and convenience of identification.

Specimens for storage and transport at low temperatures may be placed in a cryovial. The cryovial 60 is capable of meeting the handling regulations required for low temperatures. The cryovial 60 is capable of withstanding temperatures of at least below −20° C. and maintain its integrity. Preferably, the cryovavle 60 is capable of withstanding temperatures of at least below −200° C. and maintain its integrity. Once the desired number of diagnostic specimens have been placed in a specimen carrier 40, the specimen carrier 40 may be placed in an inner bladder 50.

The inner bladder 50 comprises an interior cavity 51 which is capable of receiving diagnostic specimens and specimen carriers 40 and an access opening 52, as shown in FIG. 1, providing access to the interior cavity 52. The inner bladder 50 can be made of any material that is impervious to air and liquid. The material should be compatible with dry ice and liquid nitrogen and capable of withstanding temperatures of at least below −20° C. Preferably, the material is capable of withstanding temperatures of at least below −200° C. The interior cavity 51 is capable of receiving at least one specimen carrier 40. Preferably, the interior cavity 51 is capable of receiving up to ten specimen carriers 40.

The interior cavity 51 of the inner bladder 50 is capable of being sealed, causing the inner bladder 50 to be impervious to liquid and become air tight. In one embodiment, the access opening 52 is at one end of the inner bladder 50. Preferably, the access opening 52 is located along the peripheral edge of the inner bladder 50. The inner bladder 50 has a closure flap 53 for sealing the interior cavity 51. The closure flap 53 is such that when it is folded over the access opening 52, the closure flap 53 completely covers the access opening 52. In certain embodiments, an adhesive provided on the closure flap 53 is used to secure the closure flap 53 to the outside of the inner bladder 50 thus sealing the access opening 52. In certain embodiments, a tape lining covers the adhesive until the access opening 52 is sealed. The tape lining is removable to enable closure of the access opening 52. Once the specimen carrier(s) 40 is sealed within the inner bladder 50, the inner bladder 50 may be placed in a containment jacket 10.

The containment jacket 10 is preferably made from a durable and flexible fabric such as nylon. The fabric may be made either of natural or synthetic material and is preferably liquid and air permeable. A preferred fabric is compatible with dry ice and liquid nitrogen and is capable of withstanding temperatures at least below −20° C. Preferably, the material is capable of withstanding temperatures of at least −200° C. The containment jacket has an interior cavity volume capable of receiving specimens for transportation and storage. The containment jacket is dimensionally stable at the maximum intended pressure differentials and preferably may withstand at least 95 KPa of internal pressure.

In one embodiment of the invention, the containment jacket may be comprised of a transport bag 20 and a cover 30. The transport bag 20 has an open end 24 and a closed end 25. The open end 24 opens into a first cavity 23. The first cavity 23 is preferably capable of holding up to ten specimen carriers 40, typically placed inside the inner bladder 50. Preferably the first cavity 23 is capable of holding between about six and about ten specimen carriers 40. The cover 30 has an open end 37 and a closed end 36. The open end 37 opens into a interior volume 35 of the cover 30. The interior volume 35 of the cover 30 is preferably slightly larger than the transport bag 20 such that the transport bag 20 can be secured in a position within the interior volume 35 of the cover 30. Handles 22 may optionally be attached to the outside portion of the closed ends of the transport bag 20 and the cover 30.

In certain embodiments of the present invention, the transport bag 20 may be secured within the cover 30 by first fastening members 21 attached to the closed end 25 of the transport bag 20. The cover 30 has second fastening members 31 attached to its outer surface. When the cover 30 is placed over the transport bag 20, the first fastening members 21 engage the second fastening members 31 such that the transport bag 20 is secured in position. Preferably, the handles comprise material similar to the containment jacket 10, but may be comprised of any suitable material.

In certain preferred embodiments of the present invention, the first fastening members 21 may comprise a ring portion attached to the closed end 25. The second fastening members 31 may comprise an elongated strap having two portions comprising hook and loop fastening material. A first portion 33 of the strap may preferably be attached to the outer surface of the cover 30 and may comprise loop material. A second portion 32 of the strap may preferably extend past the open end 37 of the cover 30 and may comprise hook material. When the cover 30 is placed over the transport bag 20, the second portion 32 of the second fastening member 31 that extends past the open end 37 may be threaded through the ring portion of the first fastening member 21. Once the second portion 32 of the second fastening member 31 is through the ring portion of the first fastening member 21, the second portion 32 is folded back over the first portion 33 which is attached to the cover 30. Once a second fastening member 31 is folded over the first portion 33, the loop material of the first portion 33 and the hook material of the second portion 32 engage each other and are securely held together. This process may be repeated for each fastening member of the cover 30 and transport bag 20. Preferably, the fastening members are capable of withstanding temperatures of at least below −20° C. and more preferably at least below −200° C.

Other embodiments of the present invention may contemplate other means of securing the transport bag 20 within the cover 30 and remain within the scope of this invention. This includes, but it not limited to hooks, buttons, snaps, zippers, ties or any other means known in the art. All fastening members are preferably compatible with dry ice and liquid nitrogen and are capable of withstanding temperatures at least below −20° C. and more preferably below −200° C.

Certain embodiments of the present invention provide a method for packaging specimens 60 for transport. A specimen is obtained and contained in a cryovial 60 which is placed in a specimen carrier 40. This process may be repeated for the desired number of diagnostic specimens or until each compartment 41 is filled. At least one specimen carrier 40 may be placed inside the interior cavity 51 of the inner bladder 50. Preferably, between six and seven specimen carriers 40 may be placed inside the interior cavity 51 such that each may be stacked one atop another. The tape lining is removed from the closure flap 53 of the inner bladder 50 exposing the adhesive for sealing the opening. The closure flap 53 is folded down and depressed, sealing the access opening 52 of the inner bladder 50. Preferably, once the inner bladder is sealed it maintains impermeability to air and liquid.

After it is sealed, at least one inner bladder 50 containing the specimen carrier(s) 40 may be placed inside the first cavity 23 of the transport bag 20 of the containment jacket 10. The inner bladder 50 is preferably positioned inside the first cavity 23 so that the specimen carriers 40 remain in a substantially stacked position. Once the desired number of specimen carriers 40 are stacked within the first cavity 23, the cover 30 may be placed over the transport bag 20 and secured in position. In a preferred embodiment, the transport bag 20 and the cover 30 comprise first fastening members 21 and second fastening members 31, respectively. When the cover 30 is placed over the transport bag 20, the fastening members engage one another to secure the transport bag 20 in a position within the inner volume 35 of the cover 30.

In certain embodiments of the present invention, the first fastening members 21 preferably comprise rings that may be attached near the closed end 25 of the transport bag 20. The second fastening members 31 preferably comprise elongated straps that may be attached to the outer surface of the cover 30. The second fastening members 31 may have two portions, a first portion 33 may comprise loop material and a second portion 32 may comprise hook material. It should be understood that either portion may be attached to the outer surface of the cover 30 while the other portion extends past the open end 37 of the cover 30. When the cover 30 is placed over the transport bag 20, a second portion 32 may be threaded through a ring portion of a first fastening member 21. The second portion 32 is then folded back upon the first portion 33 causing the hook and loop materials to engage and hold the ring portion of the first fastening member 21 securely. This process may be repeated for all of the fastening members of the containment jacket 10 and thus securing the transport bag 20 in a position within the interior volume of the cover 30.

Figure 4:
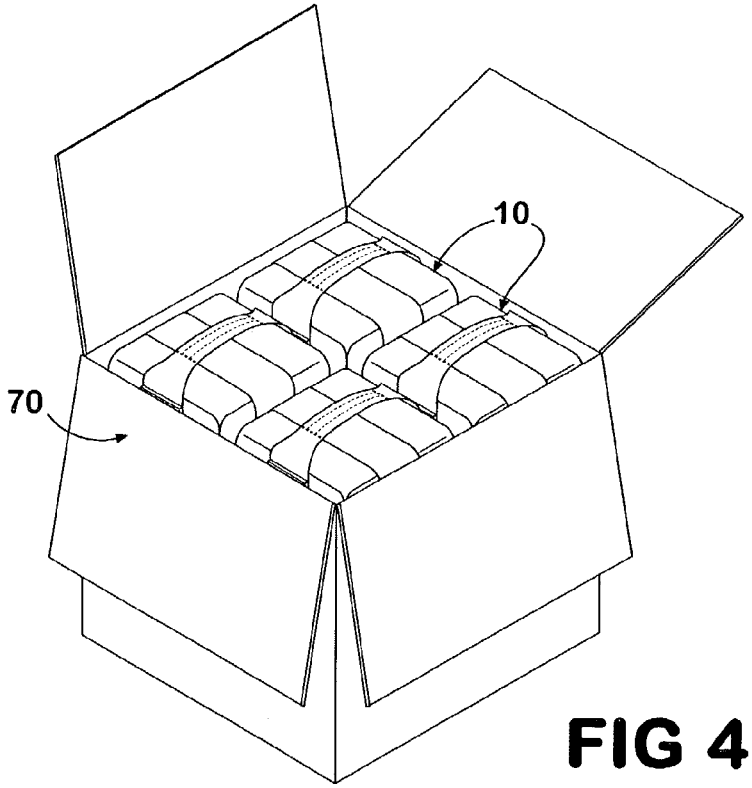
FIG. 4. is a perspective view of a plurality of containment jackets in a shipping container.

Once the transport bag 20 and cover 30 are secured in a position, making a complete containment jacket 10, at least one containment jacket 10 is placed in a shipping container 70, as shown in FIG. 4. Preferably between one and four containment jackets 10 are placed in the shipping container 70. The shipping container 70 is optionally filled with a packing material. The packing material can be natural or synthetic shock adsorbing material or a low temperature material such as dry ice or liquid nitrogen. Dry ice and liquid nitrogen are used as examples only and any low temperature packing material is contemplated for use and are within the scope of this invention. Preferably, the shipping container 70 is capable of withstanding temperatures at least below −20° C. and more preferably at least below −200° C. If the packing material is a low temperature material, the shipping container 70 may be capable of maintaining a lowered temperature for a period of time. Preferably, the period of time is at least as long as the transport time and more preferably, much longer. More preferably, the period of time is at least as long as the time needed for the use of the diagnostic specimens.

While this invention has been described in detail with particular reference to the disclosed embodiments, it will be understood that variations and modifications can be affected within the spirit and scope of the invention as described herein and as defined in the appended claims.

What is claimed is:

1. A packaging for transporting diagnostic specimens comprising:

a) an inner bladder comprising an interior cavity, an access opening and a closure flap, wherein the closure flap is capable of being folded over the access opening to seal the interior cavity, the inner bladder capable of receiving diagnostic specimens stored in a primary container; and b) a containment jacket for enclosing the inner bladder containing diagnostic specimens comprising:

i) a transport bag comprising:

A) an open end, a closed end, first fastening members and a first cavity; and ii) a cover separate from the transport bag comprising:

A) an open end, a closed end, second fastening members and an interior cavity slightly larger than the first cavity;

wherein the inner bladder containing diagnostic specimens is located in the first cavity of the transport bag and the transport bag is capable of being secured in a position within the interior cavity of the cover by engaging the first fastening members to the second fastening members sealing the containment jacket in a manner suitable for transport at a temperature below −20° C. and capable of withstanding at least 95 KPa of internal pressure.

2. The packaging of claim 1, wherein the transport bag and cover further comprise handles attached to the closed ends of each.

3. The packaging of claim 1, wherein the inner bladder comprises a material substantially flexible, substantially impermeable to air and liquid and capable of maintaining structural integrity at temperatures of at least −200° C.

4. The packaging of claim 1, wherein the containment jacket comprises a material substantially permeable to air and liquid and capable of maintaining structural integrity at temperatures of at least −200° C.

5. The packaging of claim 1, wherein the first fastening members of the transport bag comprise rings.

6. The packaging of claim 1, wherein and the second fastening members of the cover comprise a hook and loop fastening material.

7. The packaging of claim 1, wherein the containment jacket comprises nylon.

8. The packaging of claim 1, wherein the cover is attached to the transport bag.

9. A method of transporting diagnostic specimens, comprising:

obtaining a diagnostic specimen;

placing a diagnostic specimen in a specimen container;

placing the specimen container in a specimen carrier;

placing the specimen carrier in an inner bladder, wherein the inner bladder comprises a material substantially flexible, substantially impermeable to air and liquid and capable of maintaining structural integrity at temperatures below −20° C.;

placing the inner bladder in a cavity of a transport bag, the transport bag comprising an open end, a closed end, first fastening members, and a cover separate from the transport bag comprising an open end, a closed end, second fastening members and an interior cavity slightly larger than the transport cavity, wherein the transport bag is placed within the cavity of the cover;

sealing the transport bag and the cover using the first fastening members and the second fastening members;

placing at least one transport bag and the cover in a shipping container; and securing the shipping container for transport.

10. The method of claim 9, further comprising adding a packing material to the shipping container before securing for transport.

11. The method of claim 10, wherein the packing material is a shock absorbing material.

12. The method of claim 10, wherein the packing material is dry ice.

13. The method of claim 10, wherein the packing material is liquid nitrogen.

14. The method of claim 9, wherein the specimen container is a cryovial.

15. The method of claim 9, wherein the transport bag and cover comprise nylon.

16. The method of claim 9, wherein the cover is attached to the transport bag.

17. The method of claim 9, wherein the first fastening members comprise rings.

18. The method of claim 9, wherein the second fastening member comprises a hook and loop material.

19. The method of claim 9, further comprising handles attached to the closed ends of the transport bag and cover.

* * * * *